United States Patent [19]

Fiedziuszko

[11] 4,453,146

[45] Jun. 5, 1984

[54] DUAL-MODE DIELECTRIC LOADED CAVITY FILTER WITH NONADJACENT MODE COUPLINGS

[75] Inventor: Slawomir J. Fiedziuszko, Palo Alto, Calif.

[73] Assignee: Ford Aerospace & Communications Corporation, Detroit, Mich.

[21] Appl. No.: 425,015

[22] Filed: Sep. 27, 1982

[51] Int. Cl.[3] ..... H01P 1/208; H01P 7/10; H01P 7/06

[52] U.S. Cl. ..... 333/212; 333/227; 333/230

[58] Field of Search ..... 333/202, 206–212, 333/222–235

[56] References Cited

U.S. PATENT DOCUMENTS

| | | | |
|---|---|---|---|
| 3,936,775 | 2/1976 | Snyder | 333/212 |
| 4,167,713 | 9/1979 | Pfitzenmaier | 333/212 |
| 4,180,787 | 12/1979 | Pfitzenmaier | 333/212 |
| 4,396,896 | 8/1983 | Williams | 333/212 |

*Primary Examiner*—Marvin L. Nussbaum

*Attorney, Agent, or Firm*—Edward J. Radlo; Robert D. Sanborn

[57] ABSTRACT

An electromagnetic cavity filter (10) is formed by at least two cavities (12) having electrically conductive walls (40, 15). When more than two cavities (12) are employed, their midpoints do not have to be colinear; rather, it is sufficient that the angle formed by the midpoints of any three successively coupled cavities is an integral multiple of 90°. Thus, a folded "engine block" geometry can be realized such that the filter's input cavity (12) is proximate to the output cavity (12). This allows a canonic filter response. Each cavity (12) is the equivalent to two filter poles because two orthogonal modes of electromagnetic radiation can resonate therewithin. Electrically nonadjacent modes of proximate cavities (12), as well as electrically adjacent modes, can be coupled, permitting elliptic filter functions. Electrically nonadjacent modes are coupled by means of an iris (30) opening between the two cavities (12). Electrically adjacent modes are coupled by means of an electrically conductive probe (22) penetrating each of the two cavities (12). A dielectric resonator (20) can be disposed within each cavity (12) to reduce the physical size of the cavity (12) while preserving its electrical characteristics.

7 Claims, 5 Drawing Figures

DUAL-MODE DIELECTRIC LOADED CAVITY FILTER WITH NONADJACENT MODE COUPLINGS

DESCRIPTION

1. Technical Field

This invention pertains to the field of filtering electromagnetic energy, particularly at microwave frequencies, by means of resonant cavities, in which dielectric elements may be positioned.

2. Background Art

Prior art uncovered by a search at the U.S. Patent and Trademark Office and known by other means includes the following:

U.S. patent application Ser. No. 262,580 filed May 11, 1981, and now abandoned, having the same inventor and the same assignee as the present invention, discloses a dual mode filter comprising several colinear dielectric loaded resonant cavities with their successive endwalls coupled. In the present invention, on the other hand, it is sufficient that the angle formed by the midpoints of any three proximate cavities is an integral multiple of 90°; and the sidewalls, not the endwalls, of the cavities are coupled. The reference uses iris or probe couplers between proximate cavities but does not suggest the use of a combined iris and probe coupling the same two cavities as in the present invention.

The reference device is mechanically difficult to mount and assemble, particularly in applications such as satellite transponders where complicated bracketing is necessary. Furthermore, the space between the cylindrically-shaped filter and surrounding planar equipment is not fully utilized. An optimum canonic filter realization for equal or greater than 6 poles requires an input and an output to be located in the same cavity; isolation between these two ports is difficult to achieve.

The present invention offers the following advantages: It is compatible with miniature MIC devices and is mechanically easier to mount. Integration with equalizers and isolators in the same housing is made possible. Because the cavities can follow a geometrically folded pattern, a realization of an optimum canonic response is easily achievable. Because of its larger heatsinking cross-section, the present invention has better heat transfer characteristics, especially in a vacuum environment. Therefore, application at higher power levels is possible.

The reference patent application is elaborated upon in S. J. Fiedziuszko and R. C. Chapman, "Miniature Filters and Equalizers Utilizing Dual Mode Dielectric Resonator Loaded Cavities", 1982 International Microwave Symposium, IEEE MTT, June 15–17, 1982.

U.S. Pat. No. 4,216,448 discloses an "engine block" filter comprising several cavities. However, the patent uses a single coaxial TEM mode, and does not suggest the dual mode operation of the present invention. Dual mode operation allows the number of poles in the filter to be doubled because two modes resonate simultaneously within the same cavity, and one pole corresponds to each mode. This is very important in applications where weight and size are critical, such as in spacecraft. The reference patent is capable of coupling electrically adjacent modes only, not electrically nonadjacent modes as in the present invention. The reference patent does not suggest the use of dielectric resonators as in the present invention. The patent's tuning screws protrude through the endwalls, not sidewalls as in the present invention. The reference does not suggest the use of a combined iris and probe coupler.

U.S. Pat. No. 4,135,133 shows a colinear dual mode filter. It does not show combined iris/probe intercavity couplers. It does not show dielectric loading and does not show how one can geometrically fold the filter as in the present invention.

U.S. Pat. No. 4,267,537 is a circular $TE_{omn}$ mode sectorial filter, not a dual mode folded geometry cavity filter as in the present invention.

U.S. Pat. No. 3,516,030 shows in FIG. 1 hole 4 in conjunction with rod 20 between two cavities 1 and 2; hole 4 is not an iris because it does not interconnect the two cavities.

Other references are U.S. Pat. Nos. 2,406,402; 3,475,642; and 3,680,012.

DISCLOSURE OF INVENTION

The present invention is a device for filtering electromagnetic radiation, comprising two or more resonant, generally cylindrical cavities (12). Angles connecting the midpoints of any three proximate cavities (12) can be any integral multiple of 90°, permitting a geometric folded, or "engine block" arrangement, in which that cavity (12) accepting the filter (10) input is proximate to two cavities (12), one of them generating the filter (10) output. Sidewalls (40) of cavities (12) are intercoupled, rather than endwalls (15) as in prior art dual-mode filters.

Resonating within each cavity (12) can be two orthogonal degenerate modes of electromagnetic energy, i.e., $HE_{111}$ waveguide modes. Intercavity coupling is achieved by an iris (30), a probe (22), or a combination iris (30) and probe (22) coupling the same two cavities (12). Two electrically nonadjacent modes are coupled by an inductive iris (30). Two electrically adjacent modes are coupled by a capacitive probe (22). Each cavity (12) can be loaded with a dielectric resonator (20) so as to reduce the size and weight of the filter.

The use of dual modes allows for two filter poles per cavity (12). Compared with single mode filters, the present invention thus offers an approximate doubling in filter capability for the same weight and size.

The present invention offers mechanical mounting advantages compared with dual mode colinear filters, and can be readily integrated with other components, e.g., equalizers and isolators, in the same housing (28). Because of the geometrically folded, "engine block" design, a realization of optimum canonic response is easily achievable.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 1:
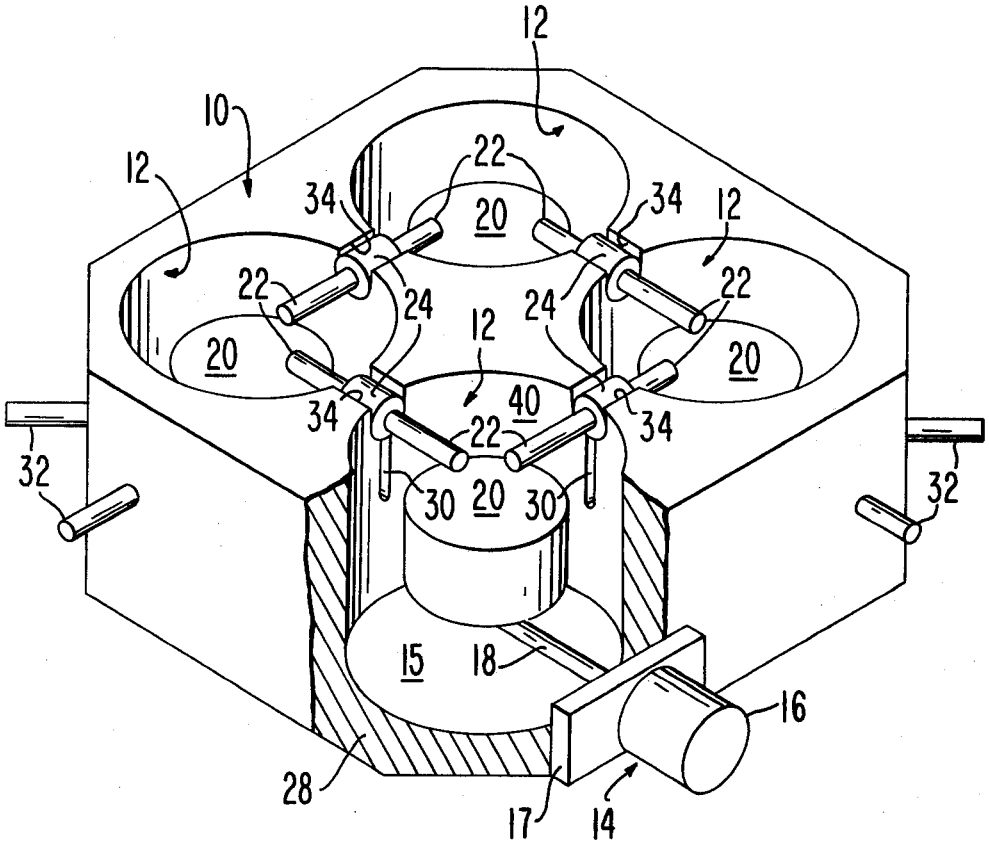
FIG. 1 is an elevated isoplanar view, partially in cross-section, of one embodiment of the present invention.

The number of cavities 12 in the present invention is at least 2. FIG. 1 shows an embodiment with four cavities 12. Filter 10 comprises a housing 28, which in the illustrated embodiment is roughly in the shape of a cubical engine block, into which have been opened four substantially identical cavities 12. Each cavity 12 has a generally cylindrical shape formed by upper and lower endwalls 15 interconnected by a generally cylindrical-sleeve-shaped sidewall 40. For ease of illustration, filter 10 is shown in FIG. 1 with its top sliced off, so that the upper endwalls 15 are not seen. Each endwall 15 is substantially orthogonal to its associated sidewall 40.

The "longitudinal axis" of a cavity 12 is defined as an axis perpendicular to the endwalls 15 and parallel to the sidewall 40. The longitudinal axes of all cavities 12 in the filter are generally parallel, with all upper endwalls 15 lying in substantially one plane and all lower endwalls 15 lying in substantially another plane. Thus, the cavities 12 are sidewall-proximate rather than endwall-proximate. "Proximate" as used herein means having a separation less than the distance of an endwall 15 radius. Cavities 12 must be close enough to facilitate coupling but not so close as to offset the mechanical integrity of the housing 28 or allow leakage of electromagnetic energy between cavities.

Each endwall 15 has a shape that remains constant when the endwall is rotated in its own plane by an integral multiple of 90°.

One of the cavities 12, in this case the frontmost cavity, is shown having a port 14 which provides a path for input energy into filter 10, or output energy from filter 10. Port 14 can be any means for coupling an electromagnetic resonant cavity with an exterior environment. For illustrated purposes, port 14 is shown as a coaxial coupler having a cylindrical outer conductor 16, a dielectric mounting plate 17, and an inner conductive probiscus 18 extending into the cavity. Tuning and coupling screws (generically referenced as 32 in FIG. 1 and more particularly referenced as 44, 46, and 48 in FIGS. 2 and 3) protrude through sidewalls 40 of cavities 12 for provoking derivative orthogonal modes and for determining the degree of coupling between orthogonal modes, as more fully described below.

Each cavity 12 can have therewithin a dielectric resonator 20, preferably with a high dielectric constant and a high Q. The dielectric resonators 20 allow for a physical shrinking of the filter 10 while retaining the same electrical characteristics, which is important in applications where filter weight and size are critical, e.g., in spacecraft. Each resonator 20 should have substantially the same dielectric effect. Therefore, it is convenient for all resonators 20 to have substantially the same size and shape (illustrated here as right circular cylindrical), and substantially the same dielectric constant.

When resonators 20 are employed, the midpoint of each resonator 20 does not have to be situated along the midpoint of its cavity's longitudinal axis. However, the longitudinal axis of the resonator 20 should be parallel to its cavity's longitudinal axis. In any plane orthogonal to these two axes and bifurcating both cavity 12 and resonator 20, the shape of the resonator 20 cross-section, and the cavity 12 cross-section should be the same (the size of the resonator 20 cross-section will be less than or equal to that of the cavity 12 cross-section), and the resonator 20 cross-section should be centered within the cavity 12 cross-section. The resonator 20 cross-section and the cavity 12 cross-section should both satisfy the rule that their common shape must remain unchanged following rotation in this bifurcating plane by an integral multiple of 90°. Thus, this common shape can be a circle, square, octogon, etc. Resonator 20 is kept in place within cavity 12 by a material having a low dielectric constant, such as styrofoam, or by a metal or dielectric screw (or other means) disposed along the cylindrical axis of the resonator 20 and cavity 12.

The insertion loss of the filter is determined by the Q-factors of the individual dielectric resonator 20 loaded cavities 12, which in turn depend upon the loss of the dielectric resonator 20 material and the material used to position the resonator 20 within the cavity 12.

Note that with this folded, "engine block" geometry illustrated in FIG. 1, canonic filters, in which the filter's input cavity must be coupled to the output cavity, can be attained. FIG. 1 does not show an output port; however, the leftmost cavity 12 or the rightmost cavity 12 could serve as the output cavity by having an output port connected thereto, which port would be obscured by FIG. 1 if it were on one of the two back walls or on the bottom of housing 28.

Coupling between two proximate cavities 12 is accomplished by means of an inductive iris 30, an opening connecting the two cavities, by a capacitive conductive probe 22 penetrating the two cavities; or by a combination of an iris 30 and a probe 22. There is no requirement that the midpoint of a coupler (22 and/or 30) be halfway along the longitudinal axis of the cavities 12 coupled thereby.

Each probe 22 couples two electrically adjacent modes 12, while each iris 30 couples two electrically nonadjacent cavities 12. This is explained in more detail below in conjunction with the description of FIG. 5.

Probe 22 is an elongated electrically conductive member extending into both cavities 12 coupled thereby. The probe 22 is insulated from the electrically conductive cavity 12 walls 40 by means of a cylindrical dielectric sleeve 24 surrounding probe 22 and fitting into cylindrical notch 34 cut into housing 28. The length of probe 22 is dependent upon the desired electrical characteristics. As one lengthens probe 22 the bandwidth increases, and vice versa. The exact length of probe 22 is determined experimentally.

If a resonator 20 and a probe 22 are both employed, decreasing the distance between these two items will cause an increase in the sensitivity of the electrical characteristics with respect to reproducibility of results, temperature variations, and mechanical vibration.

Iris 30 is an elongated opening aligned along the longitudinal axis of and interconnecting two cavities 12 coupled thereby. The width of iris 30 depends upon the desired electrical characteristics. The wider the iris, the wider the bandwidth of the resulting filter section.

When a probe 22 and an iris 30 are used together to couple the same two cavities 12, iris 30 may or may not be bifurcated by probe 22. When it is so bifurcated, its length should be shortened slightly to retain the same electrical characteristics.

Figure 4:
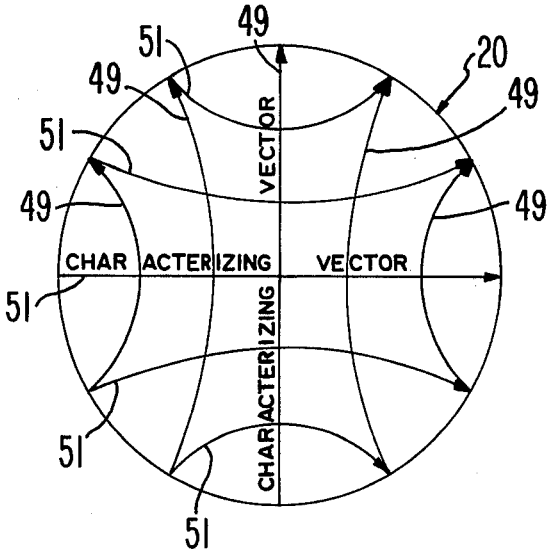
FIG. 4 is a sketch of the electric field distribution of a first electromagnetic mode (49) within dielectric (20) of a cavity (12) of the present invention, and the electric field distribution of a second, orthogonal mode (51)

FIG. 4 illustrates a cross-section of a dielectric resonator 20 showing two orthoginal modes resonating therewithin. A first mode is designated by arrows 49 and shows the general distribution of the electric field vectors defining the mode. A second, orthogonal mode is designated by arrows 51 and shows the electric field distribution of that mode.

Each mode can be represented solely by its central vector, i.e., the straight arrow, known throughout this specification and claims as the "characterizing vector" for that mode. Thus, in FIG. 5, each of four cavities 12 in an "engine block" filter is shown having two orthogonal modes therewithin. The modes are numbered 1 through 8 and are illustrated by their respective characterizing vectors.

It is assumed that 58 is the output port and 52, 54, 56, and 60 are intercavity couplings. Each intercavity coupling comprises a probe 22, an iris 30, or both a probe 22 and an iris 30. Let us assume that input electromagnetic energy enters the lower left cavity 12 via input port 50, and that its initial mode of resonance is mode 1. A second, orthgonal mode, mode 2, is provoked within this cavity 12. Let us assume that one desires to excite modes 3 and 4 within the upper left cavity 12. Mode 4 is electrically nonadjacent to mode 1, and mode 3 is electrically adjacent to mode 2. Then intercavity coupler must comprise a probe 22 and an iris 30.

As used throughout this specification and claims, "electrically nonadjacent modes" or "nonadjacent modes" are two modes resonating within proximate cavities 12, and whose characterizing vectors are parallel but not colinear. Thus, in FIG. 5, the following pairs of modes satisfy the definition of electrically nonadjacent modes: 1 and 4, 3 and 6, 5 and 8, and 7 and 2.

As used throughout this specification and claims, "electrically adjacent modes" or "adjacent modes" are two modes resonating within proximate cavities 12, and whose characterizing vectors are both parallel and colinear. Thus, in FIG. 5, the following pairs of modes satisfy the definition of electrically adjacent modes: 2 and 3, 4 and 5, 6 and 7, and 8 and 1.

One does not wish to couple together pairs of modes from proximate cavities 12 but whose characterizing vectors are perpendicular. Under the above definitions, these pairs of modes are neither electrically nonadjacent nor electrically adjacent. Similarly, modes from the same cavity 12 and modes from non-proximate cavities 12 are neither electrically nonadjacent nor electrically adjacent.

As is well known in the art, in designing a filter one combines several cavities using a certain sequence of electrically adjacent and electrically nonadjacent mode couplings. These design goals are easily realized in the present invention, in which to couple a pair of electrically nonadjacent modes, one uses an iris 30 between the two associated proximate cavities 12; and to couple electrically adjacent modes, one uses a probe 22 between the two associated proximate cavities 12. If one wishes to couple both the elecrtrically nonadjacent and the electrically adjacent modes of the same two cavities 12, one uses both an iris 30 and a probe 22 between the cavities.

Figure 5:
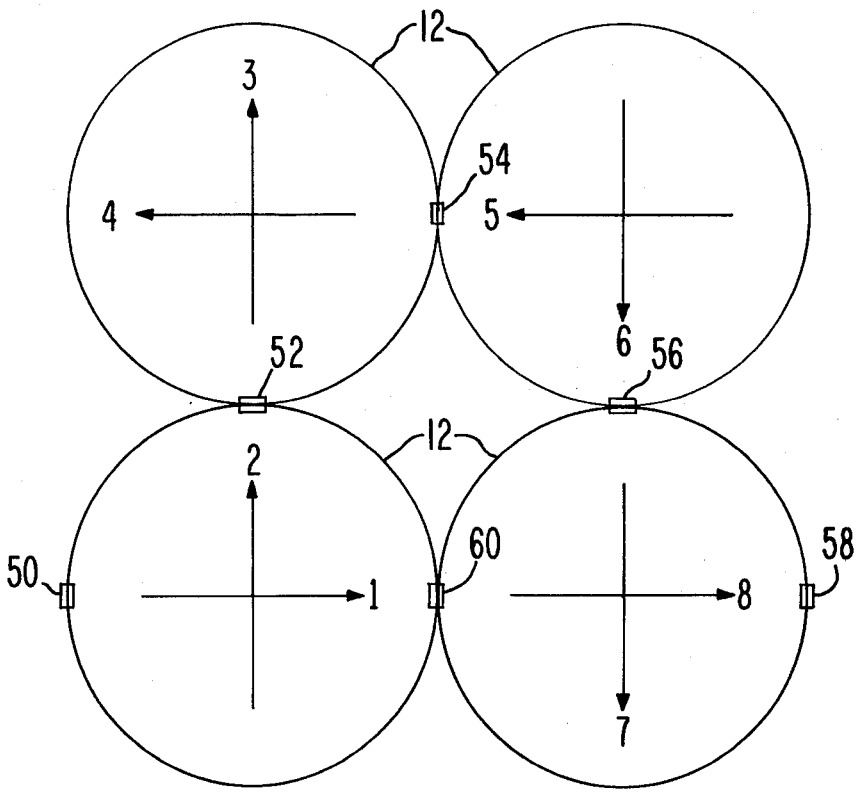
FIG. 5 is a sketch viewed from above of a four cavity (12) embodiment of the present invention illustrating orthogonal mode characterizing vectors (1 through 8) within the cavities (12).

Thus, in FIG. 5, if one wishes to excite modes 1, 2, 3, 6, 7, and 8, one would excite mode 2 as described below, use a probe 22 for coupler 52 to excite mode 3, an iris 30 for coupler 54 to excite mode 6, and a probe 22 for coupler 56 to excite mode 7, then excite mode 8 as described below. One would use a probe 22 for coupler 60 if one wished to couple electrically adjacent modes 1 and 8. Similarly, one would use an iris 30 for coupler 60 if one wished to couple electrically nonadjacent modes 2 and 7.

Figure 2:
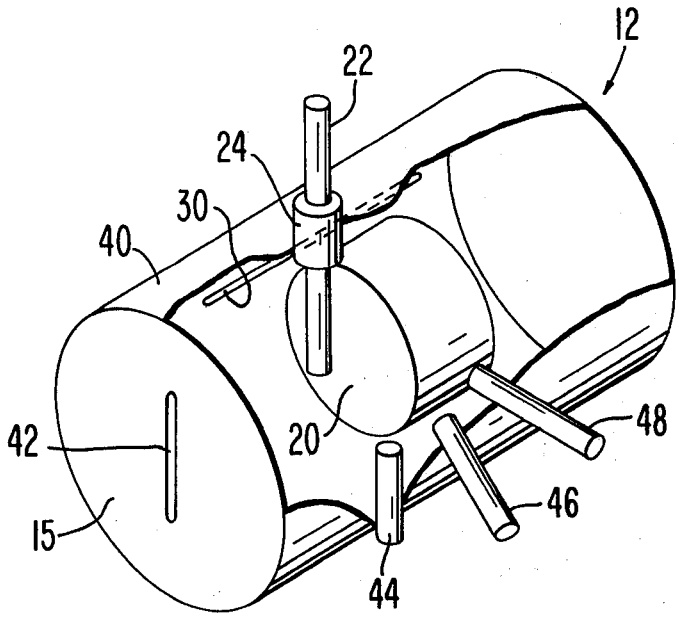
FIG. 2 is one embodiment of an individual cavity (12) of the present invention.

FIG. 2 shows details of one embodiment of cavity 12 suitable for use in the present invention. Iris 42, an elongated slot cut into endwall 15 of cavity 12, serves as an input or output port to cavity 12. Other types of ports could be utilized, as is well known in the art. Two intercavity couplers are illustrated in FIG. 2, a probe 22 and an iris 30 disposed 90° apart from each other along the circumference of sidewall 40. The probe 22 is perpendicular to sidewall 40, while the iris 30 is aligned along the longitudinal axis of sidewall 40.

The inside surfaces of walls 40 and 15 must be electrically conductive. This can be achieved, for example, by sputtering a thin layer of silver or other conductive material onto a drilled-out lightweight dielectric housing 28.

Turning screws 44 and 48, which could be dielectric as well as conductive, serve to perturb the electrical field distribution of modes propagating within cavity 12. This perturbation could be accomplished by other means, e.g., by indenting sidewall 40 at the point of entry of the screw. Screws 44 and 48 are orthogonal to each other; one is colinear with the characterizing vector of the initial mode brought into cavity 12, i.e., by port 42 when that port is an input port; in this case, screw 44 controls this initial mode. Screw 48 then controls the orthogonal mode, known as the derivative mode, which is provoked by screw 46.

The function of each screw 44 and 48 is to change the frequency of the mode defined by the characteristic vector that is colinear with that particular screw. Inserting the screw further into the cavity 12 lowers the resonant frequency of that mode.

Screw 46, which could be dielectric as well as conductive, is a coupling screw which provokes the derivative mode and controls the degree of coupling between the initial mode and the derivative mode. The more one inserts coupling screw 46 into cavity 12, the more one excites the derivative mode within the cavity.

FIG. 2 shows the penetration points of all the tuning screws grouped within the same 90° circumference of sidewall 40, but this is not necessary as long as screws 44 and 48 are orthogonal to each other and screw 46 forms substantially a 45° angle with respect to each of screws 44 and 48. All of the screws are orthogonal to the sidewall 40.

Figure 3:
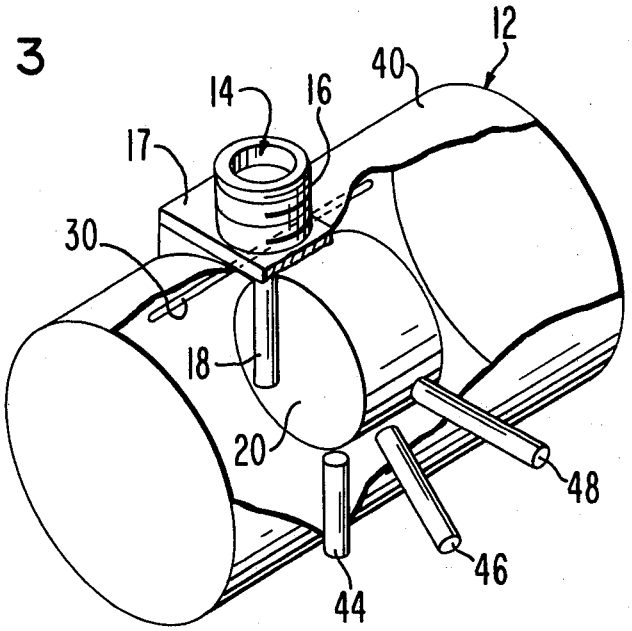
FIG. 3 is an alternative embodiment of an individual cavity (12) of the present invention.

FIG. 3 illustrates an alternative embodiment for cavity 12 in which the input or output function is performed by port 14, illustrated to be a coaxial coupler protruding through and orthogonal to a sidewall 40. Port 14 consists of outer cylindrical conductor 16, probiscus 18 extending into cavity 12 and separated from outer conductor 16 by a dielectric, and dielectric mounting plate 17. Port 14 is disposed 90° circumferentially apart from intercavity coupling iris 30 along sidewall 40.

Several C-band filters employing the above teachings have been designed, built and tested, including an 8-pole quasi-elliptic filter and several 4-pole filters. Measured performance of all the filters was excellent. All resonators 20 were fabricated of a ceramic material called Resomics manufactured by Murata Mfg. Co. with $Q=8000$ at C band. The resonators 20 were mounted in low-loss, low dielectric constant rings in silver plated aluminum housings 28. Measured results indicated minimal degradation of resonator Q. The temperature characteristics of filters constructed according to the teachings of the present invention are mainly determined by the temperature characteristics of the dielectric resonators 20. Excellent stability (better than INVAR) was achieved with the Resomics resonators 20.

For the 8-pole filter, the probes 22 were cylindrical with diameters of approximately 1.3 mm and lengths of approximately 10.7 mm. Each of the four cavities 12 was 2 cm long with a diameter of 2.5 cm. Each dielectric resonator 20 was 0.68 cm along its longitudinal axis with a diameter of 1.6 cm. The irises 30 had lengths of approximately 20 mm and widths of approximately 2.5 mm. Weight of the 8-pole filter was about 100 grams, about half the weight of comparable lightweight graphite fiber reinforced plastic colinear filters, and a third of the weight of thin-wall INVAR colinear filters.

For one of the 4-pole filters, the cylindrical probes 22 had diameters of approximately 1.3 mm and lengths of approximately 1.9 mm. Each of the two cavities 12 had a length of 2 cm and a diameter of 2.5 cm. Each resonator 20 had a length of 0.68 cm and a diameter of 1.6 cm. The irises 30 had lengths of approximately 20 mm and widths of approximately 2.5 mm. Weight was 60 grams. Insertion loss was 0.2 kB (40 MHz equal ripple bandwidth), corresponding to a Q of about 8000. Spurious responses exhibited an adequate spacing (500 MHz). Selection of a larger diameter/length ratio for the dielectric resonators 20 would substantially improve this spacing.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. An electromagnetic filter comprising two cavities defined by electrically conductive walls, said cavities having substantially the same dimensions and sharing a common wall;

wherein two orthogonal modes of electromagnetic energy resonate within each cavity; and a pair of electrically adjacent modes and a pair of electrically nonadjacent modes are coupled by means of an intercavity coupler comprising an elongated iris opening between the two cavities and an elongated electrically conductive probe extending into each of the cavities.

2. The apparatus of claim 1 wherein:

an initial mode generated outside the filter is brought into one of the cavities by means of a port penetrating a wall of said cavity;

a derivative, orthogonal mode is excited within that cavity by means of a coupling perturbation means that forms substantially a 45° angle with the characterizing vector defining the initial mode;

the pair of electrically adjacent modes is coupled via the probe, which is substantially perpendicular to the common wall; and the pair of electrically nonadjacent modes is coupled by means of the iris, which is orthogonal to the probe.

3. The apparatus of claim 1 wherein each cavity surrounds a dielectric means for allowing a physical shrinking of the cavity while preserving its electrical characteristics.

4. The apparatus of claim 3 wherein the cross-section of each allowing means in any plane that is orthogonal to the common wall and that bifurcates both the allowing means and its associated cavity has substantially the same shape as the cavity cross-section in the same plane;

within this plane, the center of the allowing means cross-section coincides with the center of the cavity cross-section; and within this plane, the shape of the cavity cross-section remains constant following its rotation by any integral multiple of 90°.

5. An electromagnetic filter comprising at least three cavities defined by electrically conductive walls, said cavities having substantially the same dimensions, with each adjacent pair of cavities electromagnetically coupled via a common wall;

wherein the angle formed by the midpoints of any three contiguous cavities is an integral multiple of 90°;

at least one of the cavities has two orthogonal modes of electromagnetic radiation resonating therewithin;

each pair of coupled cavities is coupled by an intercavity coupler comprising an elongated iris opening in the common wall and an electrically conductive probe protruding into each of the coupled cavities;

at least one of the cavities has an initial mode generated outside the filter and brought into the cavity via a port penetrating a cavity wall; and a derivative electromagnetic mode is excited within the same cavity in a direction orthogonal to that of the initial mode by means of perturbation applied at an angle of substantially 45° with respect to the characterizing vector defining the initial mode.

6. An electromagnetic filter comprising at least three cavities defined by electrically conductive walls, said cavities having substantially the same dimensions, with each adjacent pair of cavities electromagnetically coupled via a common wall;

wherein the angle formed by the midpoints of any three contiguous cavities is an integral multiple of 90°;

at least one of the cavities has two orthogonal modes of electromagnetic radiation resonating therewithin;

each pair of coupled cavities is coupled by an intercavity coupler comprising an elongated iris opening in the common wall and an electrically conductive probe protruding into each of the coupled cavities; and each cavity surrounds a dielectric resonator, with all the dielectric resonators having substantially the same size, shape, and dielectric constant.

7. The apparatus of claim 6 wherein each dielectric resonator satisfies the following three conditions with respect to any plane which is orthogonal to the longitudinal axis of its associated cavity and cuts through the dielectric resonator and said cavity forming cross-sections of the resonator and the cavity:

the shape of the resonator cross-section is the same as the shape of the cavity cross-section;

the center of the resonator cross-section is coincident with the center of the cavity cross-section; and the shape of the resonator cross-section remains constant following its rotation in said plane by an integral multiple of 90°.

* * * * *